United States Patent [19]

Leifheit

[11] 3,938,236

[45] Feb. 17, 1976

[54] METHOD OF MANUFACTURING BRUSHING APPARATUS

[75] Inventor: Güenter Leifheit, Nassau, Germany

[73] Assignee: Leifheit International Gunter Leifheit GmbH, Nassau, Germany

[22] Filed: Jan. 17, 1974

[21] Appl. No.: 433,341

Related U.S. Application Data

[62] Division of Ser. No. 302,590, Oct. 31, 1972, Pat. No. 3,815,167.

[30] Foreign Application Priority Data

Nov. 5, 1971 Germany ..... 2154971

[52] U.S. Cl. ..... 29/434; 264/295

[51] Int. Cl.[2] ..... A47I 11/08

[58] Field of Search ..... 29/434; 15/41–48; 264/295

[56] References Cited

UNITED STATES PATENTS

| | | | |
|---|---|---|---|
| 688,189 | 12/1901 | Mason | 15/41 R |
| 1,614,683 | 1/1927 | Owen | 15/41 R |
| 2,068,943 | 1/1937 | Callan | 15/41 R |
| 2,380,634 | 7/1945 | Daniels | 15/48 |
| 2,611,913 | 9/1952 | Buquor | 15/41 R |
| 2,745,125 | 5/1956 | Klumb | 15/41 R |
| 2,975,449 | 3/1961 | Liddell et al. | 15/41 R |
| 3,454,694 | 7/1969 | Delaire et al. | 264/295 |
| 3,509,613 | 5/1970 | Koenig | 264/295 |
| 3,629,892 | 12/1971 | Smyth | 15/48 |
| 3,665,540 | 5/1972 | Leifheit et al. | 15/45 |

FOREIGN PATENTS OR APPLICATIONS

| | | | |
|---|---|---|---|
| 1,068,082 | 5/1967 | United Kingdom | 264/295 |

*Primary Examiner*—C. W. Lanham
*Assistant Examiner*—Dan C. Crane
*Attorney, Agent, or Firm*—Michael J. Striker

[57] ABSTRACT

A brushing apparatus for carpets and the like has a housing one side of which faces a surface to be brushed and is provided with a plurality of wall portions connected with one another by weakened hinge-like zones so that these wall portions are produced in flat condition and can then be displaced relative to one another to a condition in which they define a trough. A brush extends along the trough and, when rotated in response to movement of the brushing apparatus over the surface, picks up dirt and deposits it in the trough.

4 Claims, 5 Drawing Figures

METHOD OF MANUFACTURING BRUSHING APPARATUS

CROSS REFERENCE TO RELATED APPLICATION

This is a divisional application of my copending application Ser. No. 302,590 filed Oct. 31, 1972.

BACKGROUND OF THE INVENTION

The present invention relates to a brushing apparatus, and more particularly to a brushing apparatus for carpets and the like.

Brushing apparatus of this type here in question, that is so-called "sweepers", is already known. Such devices have housings from the underside of which one or more rotary brushes extend so that they will contact the carpet as the sweeper is moved over the same, to pick up dirt from the carpet. Of course, the dirt must be deposited somewhere once it has been picked up; consequently, the known sweepers have in their housing one or more troughs or receptacles into which the dirt is deposited by the rotating brushes.

The difficulty with these prior-art devices is that the receptacles are formed of one piece with the housing so that the housing as produced already has the dirt-collecting troughs formed on it and located in the position which they are to assume in the finished device. To produce a housing of this type is, however, relatively difficult, especially if it is made of synthetic material, because this requires complicated molds. This is particularly true if the configuration of the troughs is desired to be such that they can afford optimum dirt-collecting and storage possibilities due to their shape.

Evidently, the more complicated the molds required for the production of the housing, the more expensive they will be and, in the final analysis, the more expensive the housing will be. Aside from this, however, there is the further disadvantage that the more complicated the housing, the greater will be the rate of rejections of finished housings, due to the occurrence of faults in the housing during production thereof.

SUMMARY OF THE INVENTION

Accordingly, it is a general object of the present invention to avoid these disadvantages.

More particularly, it is an object of the present invention to provide a brushing apparatus of the type under discussion, in which these disadvantages are avoided.

Still more particularly, it is an object of the present invention to provide such a brushing apparatus which has a housing in which the portions constituting the dirt-collecting trough or troughs can be produced in an inexpensive manner with the simplest molds and with the largest possible elimination of fault developments.

In keeping with these objects, and others which will become apparent hereafter, one feature of the invention resides in a brushing apparatus, particularly for carpets and the like, which includes a combination of a housing having a side facing a surface to be brushed and provided with a plurality of wall portions which are connected by flexible wall zones so as to be displaceable from an initially flat condition to an operative condition in which the wall portions constitute the bottom wall and at least one of the transverse and longitudinal walls of a dirt-collecting trough. Retaining portions are provided for retaining the wall portions in operative condition, and at least one brush is journalled in the housing laterally adjacent the trough and projecting in part from the side facing the surface to be brushed, for contact with this surface.

So constructed, the brushing apparatus according to the present invention, and especially the housing thereof, can be produced very inexpensively and very simply, and the wall portions can be readily moved from their initially flat position to their operative position in which they define the trough. Moreover, especially the fact that the wall portion which, in the operative condition, will be the longitudinal wall portion of the trough which extends along the brush roller, is formed in flat condition with the other wall portions, constitutes a significant advantage, because this greatly reduces the difficulties of producing these wall portions and of the molds required for such production, especially in view of the fact that this particular longitudinal wall portion must be inclined at an angle to the bottom wall portion of the trough in order to provide for optimum dirt-introducing results.

It is particularly advantageous if the flexible wall zones are so-called integral hinges, that is portions of the material from which the wall portions themselves are produced, which have a substantially lesser thickness than the wall portions and can readily flex. In the region of these wall zones there will be provided the retaining portions in the form of noses or other abutments, which engage one another when the wall portions have been displaced to operative condition. Thus, the displacing to operative condition can be effected without special tools and an automatic relative location of the various wall portions in the desired final position will be obtained, because the positions will have been reached when the respective noses abut one another.

It is already known to arrange such dirt-collecting troughs pivotable between a dirt-collecting and a dirt-discharging position. This can be accomplished in the construction according to the present invention also, for which purpose the trough can be journalled on a shaft located in the housing, and the longitudinal trough wall which extends along the brush roller can advantageously extend with a portion of it behind the shaft so as to be held in position by the same. Thus, even if the thickness of this wall is relatively small, it is nevertheless very stable in its operating condition because it is supported by engagement with the shaft over its entire length. The height of this particular wall portion is advantageously accommodated to the distance between the pivot axis defined by the shaft and the wall zone connecting this particular longitudinal wall with the bottom wall portion. The edge of the longitudinal wall may be provided with a recess in which the shaft may in part be accommodated.

The transverse walls are provided at their free edges preferably with groove-like recesses for the legs of a biasing spring which serves to maintain the pivotably arranged wall portions in their normal position, without further preventing pivoting to dirt-discharging position. By having the legs of the springs engaged in the recesses, the transverse walls can be retained by the springs after they have been moved to the operative condition in which they form the trough with the longitudinal walls and the bottom wall. Advantageously the bottom of the respective recess is of substantially saddle-shaped configuration, and the legs in any pivotable position of the trough will always be properly located in the recess and prevent the transverse walls from moving out of their position. This particular configuration of the saddle-shaped bottom of the recess also assures that a reversal of the direction of the bias exerted on the bottom wall by the spring will take place as the trough is pivoted from the dirt-collecting to the dirt-discharging position, so that the bottom wall will be properly biased in any position of the trough. To prevent a weakening of the transverse wall it is advantageous to form the recesses in thickened portions of the transverse walls in which at the same time the journals for mounting on the shaft are formed.

The transverse walls may also be provided in the region of the pivot axis with sleeve-like projections which extend into recesses provided in the housing itself, whereby an advantageous increase of the journalling portion is achieved, and whereby further support especially in the end position of the pivoting movement is obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
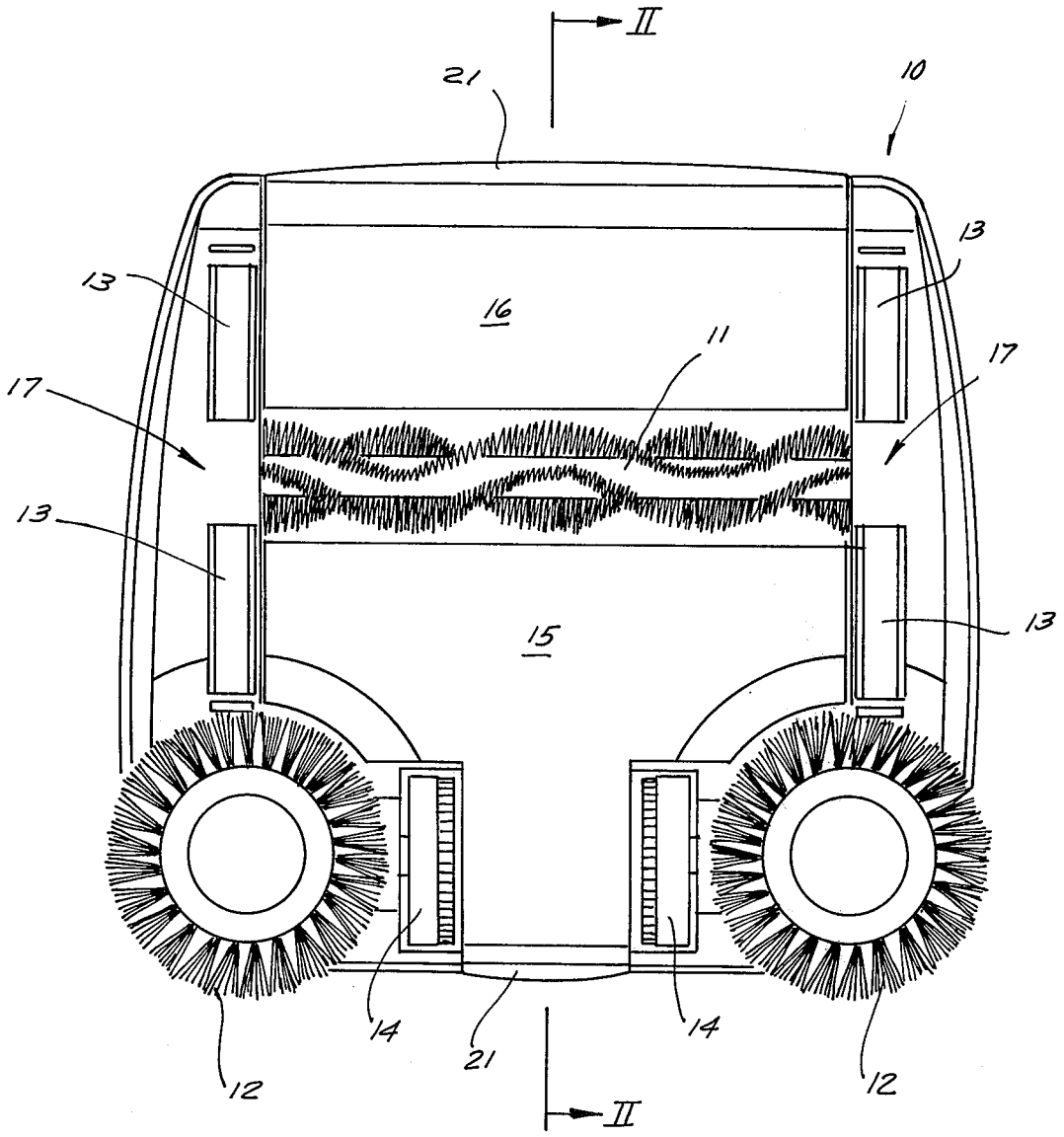
FIG. 1 is a bottom-plan view of a brushing apparatus according to the present invention.
Figure 2:
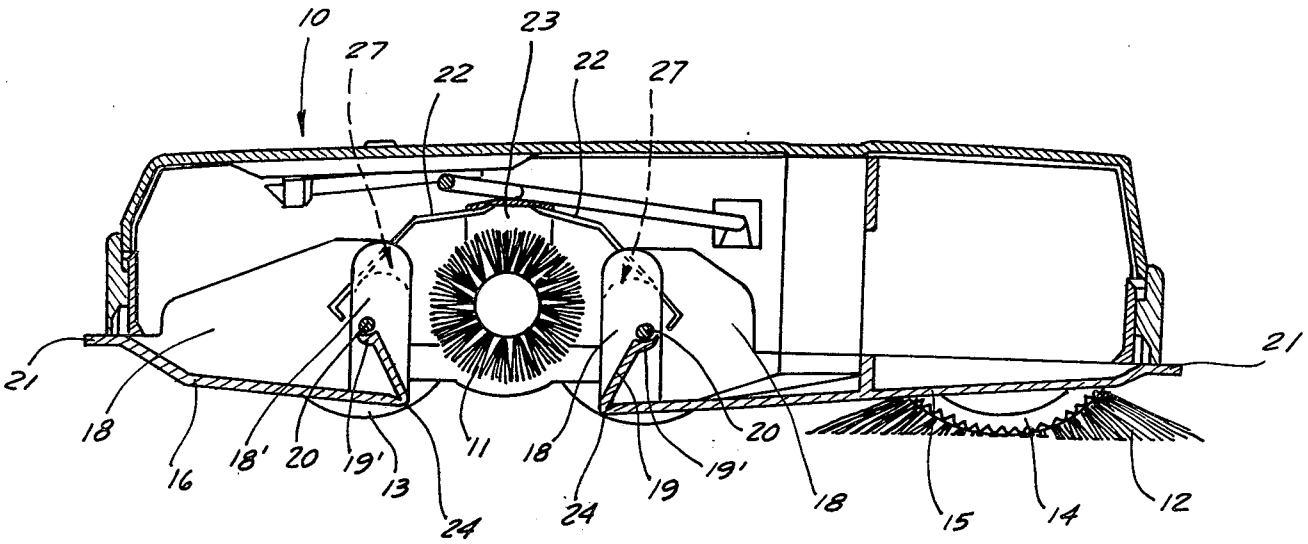
FIG. 2 is a section taken on line II—II of FIG. 1.

Discussing firstly the embodiments illustrated in FIGS. 1 and 2, it will be seen that FIG. 1 is a bottom-plan view of a brushing apparatus or sweeper in accordance with the present invention, such as is used for cleaning carpets, rugs, floors and the like. The housing of the apparatus is designated with reference numeral 10 and journalled in this housing is a brush roller 11 which can be mounted in fixed journals or in journals which can be raised and lowered with respect to the lower open side of the housing 10. ASsociated with the brush roller 11 are cup-shaped auxiliary brushes 12 whose purpose it is to pick up dirt from the lateral region of the apparatus and to convey it inwardly into the range of pick up of the brush roller 11. Of course, the brushes 12 could be omitted.

Dirt picked up by the brush roller 11, which is driven in known manner by wheels 13 which are also journalled in the housing 10, is deposited in a trough-like dirt-collecting space of the housing. Transmittal of the movement from the wheels 13 to the brush roller 11 to drive the same, can be either direct or indirect via interposed elements; it does not form a part of the present invention. The auxiliary brushes 12 are also driven by additional wheels 14, and of course the configuration of the apparatus can be different from what has been illustrated without departing from the inventive concept which will now be discussed.

The drawing shows clearly, especially in FIG. 1, that in the region at opposite sides of the brush roller 11 the lower side of the housing 10 is closed by bottom units 15 and 16 between which the brush roller extends out of the housing 10. These units 15 and 16 extend transversely of the apparatus between the journal regions 17 of the brush roller 11 and of the wheels 13, and the unit 15 is slightly cinched towards the front side of the housing, leaving space for the brushes 12 and the wheels 14.

FIG. 2 shows that the units 15 and 16 have transverse walls 18 at the inner side of the housing and in addition have a longitudinal wall 19 which extends along the brush roller 11. Thus, the units 15 and 16 constitute troughs into which the dirt picked up by the brush roller 11 can be deposited, depending upon the direction of rotation of the brush roller either into the unit 15 or into the unit 16.

When the units are in the position shown in FIGS. 1 and 2, dirt picked up by the brush roller 11 is flung over the longitudinal walls 19 into the respective receptacle, and of course the provision of the two units 15 and 16 at opposite sides of the brush roller 11 is intended to assure dirt-pick up and deposition, irrespective of the direction in which the brushing apparatus is moved over the surface.

Each of the units 15 and 16 is journalled on an axle 20 which in the illustrated embodiment also carries the pairs of wheels 13. The axles 20 are mounted in wall portions of the housing 10, and by having the units 15 and 16 mounted on the axles 20 the units can be pivoted from the dirt-receiving position illustrated to a dirt-discharging position in which dirt can be removed from them. FIG. 2 shows that the units 15 and 16 engage the front or rear side of the housing, respectively, with portions of the units in such a manner that the outwardly extending portions 21 constitute engaging portions which permit their displacement from dirt-receiving to dirt-discharging position, and vice versa. Springs 22 are provided which engage the transverse walls 18 of the units 15 and 16, biasing the same towards the dirt-receiving position illustrated in FIG. 2. The springs 22 engage housing portions; in the illustrated embodiment, a carrier 23 of the main brush roller 11. The legs of the springs each contact the transverse walls of the units 15 and 16.

Figure 3:
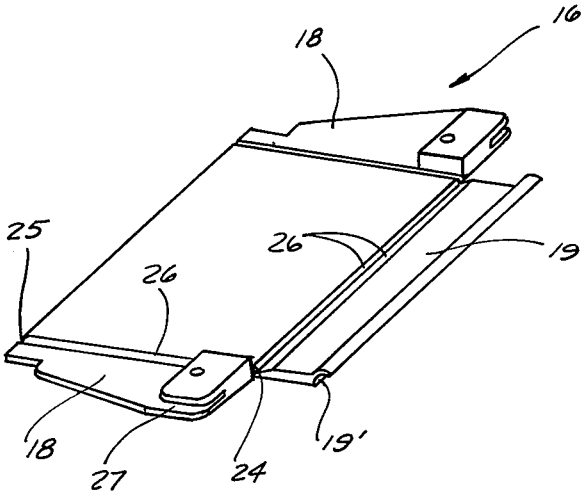
FIG. 3 is a perspective view of one embodiment in accordance with the invention.
Figure 4:
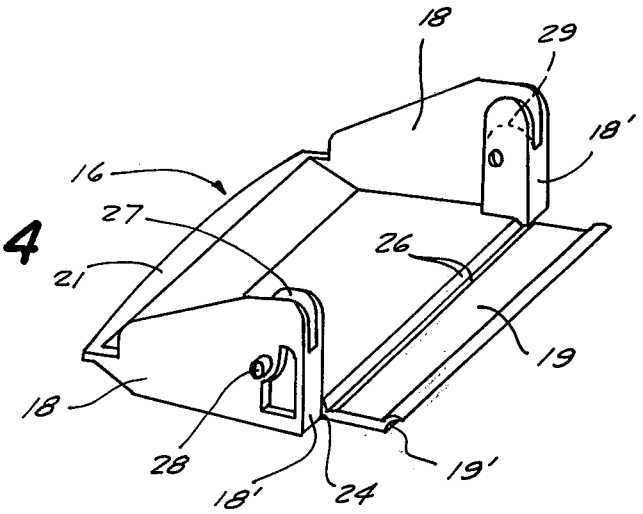
FIG. 4 is a view similar to FIG. 3 but of a different embodiment of the present invention.

The latter units are produced of one piece each, being made in the illustrated embodiment of synthetic plastic material. They may have starting configurations such as is shown in FIGS. 3 and 4, that is they may be produced in the configurations shown in FIGS. 3 and 4. The longitudinal wall portion 19 and/or the transverse wall portion 18 are located in a common plane, or at least substantially in a common plane, being connected by flexible wall zones 24 and 25. In FIG. 3 the longitudinal wall portion 19 and the transverse wall portions 18 are produced in this manner, whereas in FIG. 4 only the longitudinal wall portion 19 is produced in this manner whereas the transverse wall portions 18 are formed in their final position, that is extending partly from the bottom wall portion. Either configuration makes it possible to produce the units 15 and 16 with very simple molds and very inexpensively.

Figure 5:
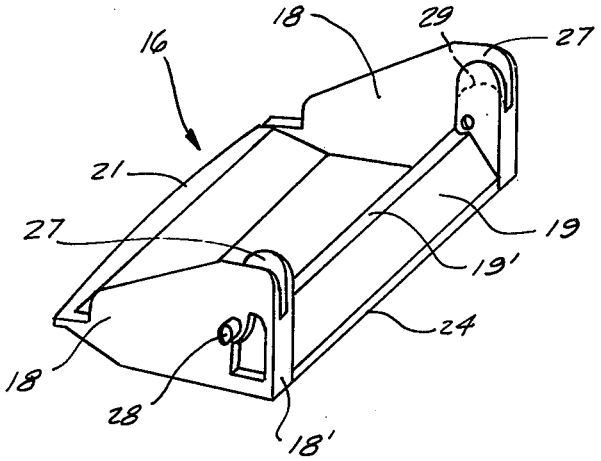
FIG. 5 illustrates an embodiment in a perspective view, showing the embodiment in operative position.

The zones 24 and 25 which separate the bottom wall portion from the longitudinal wall portion 19 and/or the transverse wall portions, 18 connecting it with the same, are constructed as integral hinges, that is as zones having a reduced thickness and being thus flexible enough to permit a displacement of the various wall portions relative to one another to the operative position without breaking or cracking. This final position is illustrated in FIG. 5. To maintain the wall portions in their final desired relative position, they are provided with retaining portions which are formed on them during production, and in the illustrated embodiment the longitudinal wall portion 19 is so configurated that when in erected condition it will be high enough to extend behind the pivot axis 20 so that it cannot fold back again. The height of the wall portion 19 is so coordinated with the distance of the associated zone 24 from the pivot axis or axle 20 that it will engage the latter when in erected condition. In particular, the wall portion 19 is provided with a longitudinal recess 19' configurated so as to at least in part receive the axle 20. The junction between the elastically yieldable zone 24 and the associated wall portions connected by it are provided with retaining portions or bevels 26 which abut one another in the position of FIG. 5.

The transverse wall portions 18 may also be formed as in FIG. 4 or, if they are formed as in FIG. 3, they may be maintained in their erected position by the springs 22. For this purpose they are then provided with groove-like recesses 27 into which legs of the springs 22 engage to stabilize the position of the transverse wall portions 18. To avoid weakening of the wall portions 18 in the region of the recesses 27 they are provided with an area 18' of greater thickness in which also outwardly extending sleeve-like projections 28 may be formed which extend into journal recesses of the housing 10.

The recesses 27 for the springs 22 are advantageously provided with a saddle-shaped bottom 29 to assure for an evenly tight engagement of the spring legs both in the dirt-receiving position and in the dirt-discharging position of the units 15 and 16. In conjunction with the arrangement of the location of the recesses 27 above the axle 20, this particular configuration of the bottom still has the additional advantage of biasing the units 15 and 16 in their pivoting plane, in such a manner that during pivoting from the dirt-receiving to the dirt-discharging position or back to the same, a reversal will occur in the biasing direction, whereby the units 15 and 16 will be maintained in the respective end position (discharging or receiving) by the springs 22.

Evidently, various changes may be made from the illustrated embodiments without departing from the invention. The brushes 12 could be omitted, the outline of the various components could be changed, additional brushes 11 could be provided, a single one of the units 15 and 16 could be provided, and other modifications could be made without departing from the invention.

It will be understood that each of the elements described above, or two or more together, may also find a useful application in other types of constructions differing from the type described above.

While the invention has been illustrated and described as embodied in a brushing apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a method of making a brushing apparatus for carpets and the like, the steps of producing a dirt-collecting trough having at least an elongated bottom wall, a longitudinal wall, transverse walls and an open top, said producing step including initially forming at least said bottom wall and said longitudinal wall in a flat condition in a common plane and with a flexible wall zone interconnecting the same, and displacing at least said longitudinal wall about said wall zone so that a marginal portion of said longitudinal wall which is parallel to and distant from said wall zone is spaced from said common plane; pivotally mounting said trough on an axle supported in a housing having an open side facing toward a surface to be brushed so that said open top faces oppositely of said open side, engaging said marginal portion of said longitudinal wall permanently with said axle to form a partial bearing for pivoting movement of said longitudinal wall about said axle and to retain said longitudinal wall against movement into the plane of said bottom wall; and installing at least one brush roller in said housing laterally adjacent said trough and projecting in part from said open side of said housing.

2. In a method as defined in claim 1, said walls having abutments; and wherein the step of displacing comprises moving said walls until said abutments engage one another.

3. In a method as defined in claim 1, wherein the step of producing comprises making said trough from synthetic plastic material.

4. In a method as defined in claim 1, wherein the step of producing comprises molding said trough.

* * * * *